US009850448B2

(12) United States Patent
Holsnijders et al.

(10) Patent No.: US 9,850,448 B2
(45) Date of Patent: Dec. 26, 2017

(54) POLYMER GREASE MANUFACTURING PROCESS

(71) Applicants: Jos Holsnijders, Leerdam (NL); Dries Muller, Nijmegen (NL)

(72) Inventors: Jos Holsnijders, Leerdam (NL); Dries Muller, Nijmegen (NL)

(73) Assignee: AKTIEBOLAGET SKF, Gothenburg (SE)

( * ) Notice: Subject to any disclaimer, the term of this patent is extended or adjusted under 35 U.S.C. 154(b) by 14 days.

(21) Appl. No.: 14/894,785

(22) PCT Filed: May 28, 2014

(86) PCT No.: PCT/EP2014/061090

§ 371 (c)(1),
(2) Date: Nov. 30, 2015

(87) PCT Pub. No.: WO2014/191470

PCT Pub. Date: Dec. 4, 2014

(65) Prior Publication Data

US 2016/0130523 A1 May 12, 2016

(30) Foreign Application Priority Data

May 30, 2013 (EP) ..... PCT/EP2013/061143

(51) Int. Cl.
*C10M 177/00* (2006.01)
*C10M 169/02* (2006.01)
(Continued)

(52) U.S. Cl.
CPC ..... *C10M 169/02* (2013.01); *C10M 105/32* (2013.01); *C10M 119/02* (2013.01); *C10M 177/00* (2013.01); *C10M 2205/003* (2013.01); *C10M 2205/02* (2013.01); *C10M 2205/024* (2013.01); *C10M 2207/2805* (2013.01);
(Continued)

(58) Field of Classification Search
CPC ..... C10M 169/02; C10M 105/32; C10M 119/02; C10M 177/00; C10M 2205/024; C10M 2209/102; C10M 2205/02; C10M 2209/12; C10M 2217/044; C10M 2209/104; C10M 2205/003; C10M 2207/2805; C10N 2250/10; C10N 2230/00; C10N 2270/00; C10N 2240/02
See application file for complete search history.

(56) References Cited

U.S. PATENT DOCUMENTS

| | | | |
|---|---|---|---|
| 2,380,893 A | 7/1945 | Zimmer et al. | |
| 2,417,495 A | 3/1947 | Houlton | |
| 2,483,282 A | 9/1949 | Houlton | |

FOREIGN PATENT DOCUMENTS

| | | | |
|---|---|---|---|
| EP | 0700986 A2 * | 3/1996 | ..... C10M 119/02 |
| EP | 0795597 A1 | 9/1997 | |
| EP | 0795598 A1 | 9/1997 | |

* cited by examiner

*Primary Examiner* — Taiwo Oladapo
(74) *Attorney, Agent, or Firm* — Bryan Peckjian; SKF USA Inc. Patent Dept.

(57) ABSTRACT

A process for the manufacture of a lubricating grease composition, the process comprising steps of: (a) providing an essentially homogeneous liquid composition comprising a lubricating oil and a thickening polymer, and (b) flowing the liquid composition through a shear-mixing device to mix and cool the liquid composition to form a lubricating grease composition.

20 Claims, 4 Drawing Sheets

(51) Int. Cl.
*C10M 105/32* (2006.01)
*C10M 119/02* (2006.01)

(52) U.S. Cl.
CPC . *C10M 2209/102* (2013.01); *C10M 2209/104* (2013.01); *C10M 2209/12* (2013.01); *C10M 2217/044* (2013.01); *C10N 2230/00* (2013.01); *C10N 2240/02* (2013.01); *C10N 2250/10* (2013.01); *C10N 2270/00* (2013.01)

POLYMER GREASE MANUFACTURING PROCESS

CROSS REFERENCE TO RELATED APPLICATIONS

This is a United States National Stage Application claiming the benefit of International Application Number PCT/EP2014/061090 filed on 28 May 2014 (28.05.2014), which claims the benefit of Europe (EP) Patent Application PCT/EP2013/061143 filed on 30 May 2013 (30.05.2013), both of which are incorporated herein by reference in their entireties.

TECHNICAL FIELD

The present invention relates to the field of polymer greases and methods for the manufacture thereof.

BACKGROUND

Greases are used in a variety of engineering applications to maintain a lubricant between moving machine surfaces, such as found, for example, in bearings. A grease exhibits shear-thinning rheological properties, which means that the viscosity of the grease reduces under shear. A grease typically comprises a lubricant, such as a lubricating mineral oil, and a thickener substance. Under non-shear conditions, the thickener acts as a sponge-like matrix that holds the lubricating oil. As a result, the grease exhibits the characteristics of a solid or semi-solid. The lubricating oil may be released from the matrix both under static or dynamic conditions. In particular, when a shear force is applied, the lubricating oil separates from the thickener matrix and results in the grease exhibiting lubricating properties.

The properties of the lubricating oil are important in determining the lubricating properties of the grease. In addition, the interaction of the lubricating oil and the thickener is important in determining, for example, the longevity of a grease when used as a lubricant. In order to prolong its life as a lubricant, the oil replenishing characteristics of the grease are critical to ensure that the lubricating oil is reabsorbed into the matrix once the shear is removed from the lubricated system.

Lubricant greases for bearings are described in EP 0700986, EP 0795597 and EP 0795598. In these documents, a polymer is used as the thickener in a grease composition. The lubricating oil is chosen to be a conventional synthetic lubricating oil, such as a mineral oil, a synthetic hydrocarbon oil or an ester oil.

As described in EP 0700986, a typical method for the manufacture of a grease is to form a homogeneous mixture of the desired lubricating oil and thickener, and then to rapidly cool or quench it. This may be achieved by pouring the composition onto a cooling table.

The present invention aims to address at least some of the problems associated with the prior art or at least to provide a commercially useful alternative thereto.

SUMMARY OF THE INVENTION

According to a first aspect, the present invention provides a process for the manufacture of a lubricating grease composition, the process comprising the steps of:

providing an essentially homogeneous liquid composition comprising a lubricating oil and a thickening polymer;

flowing the liquid composition through a shear-mixing device to mix and cool the liquid composition to form a lubricating grease composition.

The present invention will now be further described. In the following passages different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

As discussed above, conventional manufacture of polymer greases involves quenching a hot polymer/base oil mixture onto a metal plate, to room temperature. Further, it involves a mechanical treatment of the quenched material, preferably by applying shear (e.g., using a planetary mixer, a roll mill, or homogeniser) to give the grease its final properties. However, the present inventors have found that the grease properties (especially mechanical stability and stiffness) are extremely sensitive to the cooling process, particularly in combination with the shearing process. In particular, they have found that it is very difficult to reproduce the same grease quality due to the cooling process being a generic, uncontrolled step.

Moreover, the inventors have found that this issue affects bulk factory production to a greater extent than small-scale production. It is even more important to control and adjust cooling rates, heat dissipation, local heat distribution in the bulk, equilibrium temperatures and the like when working with larger volumes of grease. This becomes even more pronounced when producing large batches of, for example, 1-5 tons.

The present inventors found that a number of problems associated with the prior art could be addressed by using the new method disclosed herein. In particular, the method avoids pouring large production batches onto a casting table. It provides control over temperature variations, cooling rates and homogeneous heat distribution in the bulk. It further allows for the adjustment of cooling conditions to optimize grease production quality and avoids direct contact with ambient air, resulting in oxidation, contamination, and dust and particle ingress. Importantly, however, it also allows for adjustment of cooling conditions to obtain greases with different properties, either as a result of the cooling profile or because it allows the use of novel materials.

The present inventors have found that the conventional pouring-and-quenching method is not ideal for processing grease since it does not allow control of the cooling rate, or heat dissipation in the bulk material during cooling. Indeed, in contrast to the present method, such a cooling process cannot be adjusted to modify the grease properties.

By the term essentially homogeneous as used herein is meant that the components forming the liquid composition are essentially homogeneous and typically not visibly discernible in the mixture. In particular, the mixture preferably does not have any domains of the separate thickening polymers within the lubricating oils or vice versa. Preferably the liquid composition is homogeneous. Preferably the essentially homogeneous liquid composition is provided at a temperature of from 150 to 350° C., preferably from 200 to 250° C. These temperatures are generally required to ensure that the components forming the grease are thoroughly mixed and homogeneous. However, the properties of the components selected will determine the minimum temperature required to establish an essential homogeneous liquid composition.

Lubricating oils and thickening polymers are well known in the field of grease manufacture. The novel method has been found to permit a broader range of materials to be used when forming greases. Preferably the lubricating oil comprises oils selected from mineral oils, synthetic hydrocarbons, ester oils, vegetable oils, and mixtures of two or more thereof. Preferably the thickening polymer comprises a polymer selected from polyamides, polyesters, polyethylene oxides, polyethylene, polypropylene, polylactides, cellulose or cellulose derivatives, and mixtures of two or more thereof. The recited polymers are intended to encompass copolymers, as well.

The ratio of the lubricating oil and the thickening polymer helps to determine the structure of the final grease. The inventors have found that it is preferred when the thickening polymer forms from 5 to 20 wt %, preferably 9 to 15 wt % of the essentially homogeneous liquid composition. Working within this range ensures that the lubricating properties can be enhanced while providing a readily producible and stable grease product.

The liquid composition is flowed through a shear-mixing device to mix and cool the liquid composition to form a lubricating grease composition. The shear mixing device is preferably a shear-mixing conduit, preferably having a variable cross-sectional area. The use of a shear-mixing conduit is advantageous because it has contact surfaces for controlling the temperature of the liquid composition and it also allows for shear-mixing of the composition as it flows through. This is preferably achieved by the variable cross-section introducing shear into the mixture.

It is especially preferred that the shear-mixing device is a closed gas-tight system. This allows for greater control of the grease properties and it also reduces gas contamination of the lubricant. In addition, it reduces oxidation, which is an important factor if the temperature of the lubricant is increased during processing.

Preferably the liquid composition flows through the shear-mixing device along a flow-path provided with one or more static mixing elements. Static mixing elements allow for reproducible mixing. Examples of static mixers are well known in the art and include baffles, mixer bars and other obstructions in the flow-path.

Preferably the liquid composition flows through the shear-mixing device along a flow-path provided with a plurality of static mixing elements arranged to provide regions of increased shear mixing. Preferably the liquid composition flows through the shear-mixing device along a flow-path provided with one or more temperature-controlled portions to each heat or cool the liquid composition. That is, the shear-mixing device can be provided with a plurality of regions having alternative purposes. Some regions may be used to change the temperature of the lubricant flowing there-through, while others may be used to achieve high or low shear mixing. Regions may, of course, be used for temperature-control and/or shear-mixing.

It is especially preferred that at least one temperature-controlled portion is provided at a higher temperature than a preceding temperature-controlled portion along the flow-path. This allows for the heating of the lubricant after, for example, an initial cooling step. This can provide a controllable tempering or annealing step, which cannot be achieved using the conventional casting table approach. It therefore can be used to provide novel lubricants having previously unachievable properties.

In one embodiment, the shear-mixing device comprises one or more pairs of heat-transfer plates between which the liquid composition is flowed, wherein the surface of at least one plate is provided with surface features in the flow path of the liquid composition. As a consequence, the pair of plates provides both a means for raising, lowering or maintaining a temperature of the lubricant, while the surface features (on one or both of the pair of plates) can work the grease to shear-mix it. Preferably the temperature of the heat-transfer plates is controlled with water cooling. This is a cheap and effective way of controlling the temperature.

Advantageously, the lubricating grease composition can be continuously extruded using the method of the present invention. This has numerous advantages for packaging the grease compared to the conventional pouring-and-quenching method. Furthermore, it allows for greater control of the residency time of the grease within the system.

Preferably the shear-mixing is controlled by altering the flow rate of the liquid composition. This can be controlled, for example, by varying the gas pressure applied to a reservoir of the substantially homogeneous composition. To facilitate the quenching process, the flow rate may be decreased or stopped during the shear-mixing process, such that alternating dynamic and static quenching may occur.

Preferably, the shear rate and shear stress imposed on the grease are varied in the shear-mixing process such that properties of the final grease can be accurately controlled. In one embodiment, the shear rate is regulated by adjusting flow rate and geometry of the flow channels or flow plates. Especially, by narrowing the distance between plates, the shear rate can be increased to accommodate a higher shear stress and a more severe grease working process. In another embodiment, the shear stress is controlled by adjusting flow rate and temperature in each zone. Advantageously, this will enable grease working of quenched liquids of different rheological properties, in particular quenched liquids that possess a high degree of stiffness. The shear rate experienced by the homogeneous liquid during quenching, as well as during grease working, in the shear-mixing conduit, varies from 0 to $10^7$ $s^{-1}$. Preferably, the thickening composition forms from shear rate varying from $10^{-1}$ to $10^5$ $s^{-1}$. Preferably, the thickening composition forms from shear stress varying from 1 to $10^7$ Pa.

In one embodiment, one or more additives are added to the liquid composition in the shear-mixing device. These additives can be used to fine-tune the properties of the final grease.

In one embodiment, a small amount (e.g. 0.1-1.0%) of a co-solvent such as ethanol or water is added to the hot mixture of polymer+base oil. The co-solvent is added in order to change the solubility of the polymer in the base oil, and thus influence, e.g. the quenching temperature or thickener structure.

The process described herein provides for polymer grease synthesis whereby a hot polymer/base oil mixture is pumped through different temperature zones. This can be achieved by using a system of, for example, temperature-controlled parallel plates. These may be connected to a reactor resulting in a (semi-continuous, closed synthesis process. The polymer/base oil mixture is pumped between the plates by, for example, applying over-pressure in the reactor, resulting in a process of combined cooling and grease working. In this manner, polymer grease synthesis can be accurately controlled. In addition, conditions may be varied to adjust the properties of the polymer grease. Adjustment of cooling and grease-working may be achieved by, for example, adjusting one or more of pumping pressure and speed, gap size between the plates, shape and profile of the shape adjusted, and number of temperature zones.

The process therefore replaces the standard quenching method by combined cooling and grease working in an accurately controlled step. This allows grease synthesis with a wider range of properties and higher degree of reproducibility. The working of the grease may include shearing, straining, extrusion, rolling, forced flow and/or compression.

BRIEF DESCRIPTION OF THE DRAWINGS

The invention will now be described further, by way of example, in relation to the following non-limiting figures, in which.

DETAILED DESCRIPTION OF THE EMBODIMENTS

Figure 1:
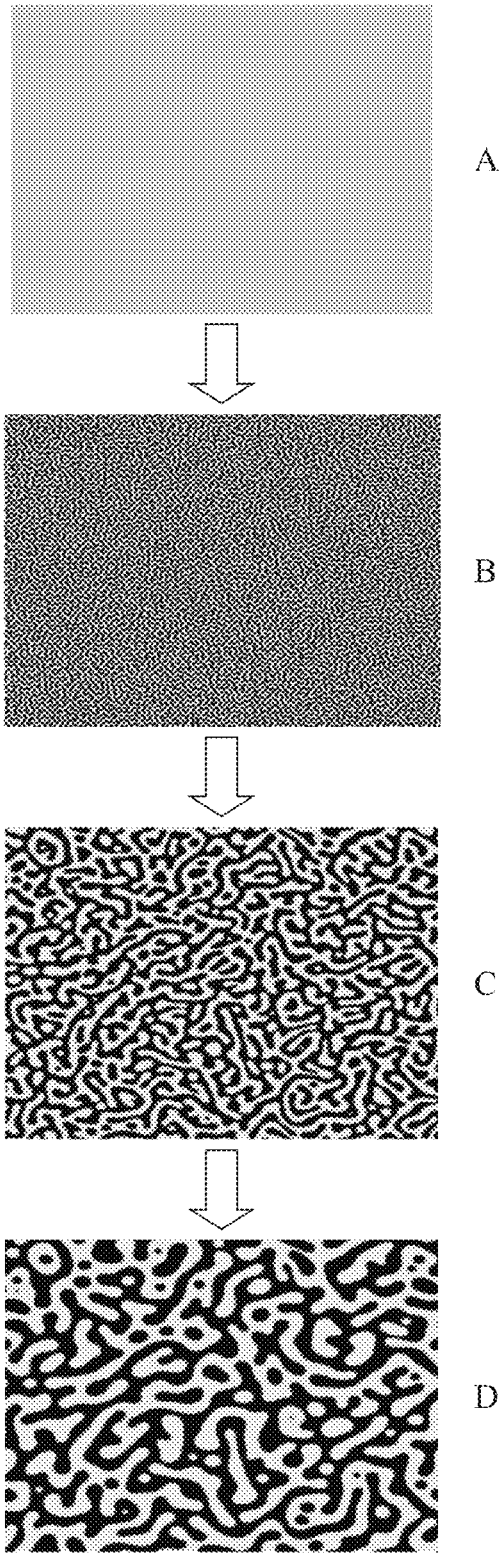
FIG. 1 shows the microstructure of a grease composition during manufacture.

As shown in FIG. 1, the formation of a grease can occur in several steps. The four slides, A-D, show the microstructures of the grease during its formation. In slide A, the hot liquid composition (or "solution") is essentially homogeneous. In slide B, following quenching, there is a liquid-liquid separation. In slide C, there is some solidification as the thickener structure forms. With on-going working of the grease, a more stable structure is formed in slide D.

Figure 2:
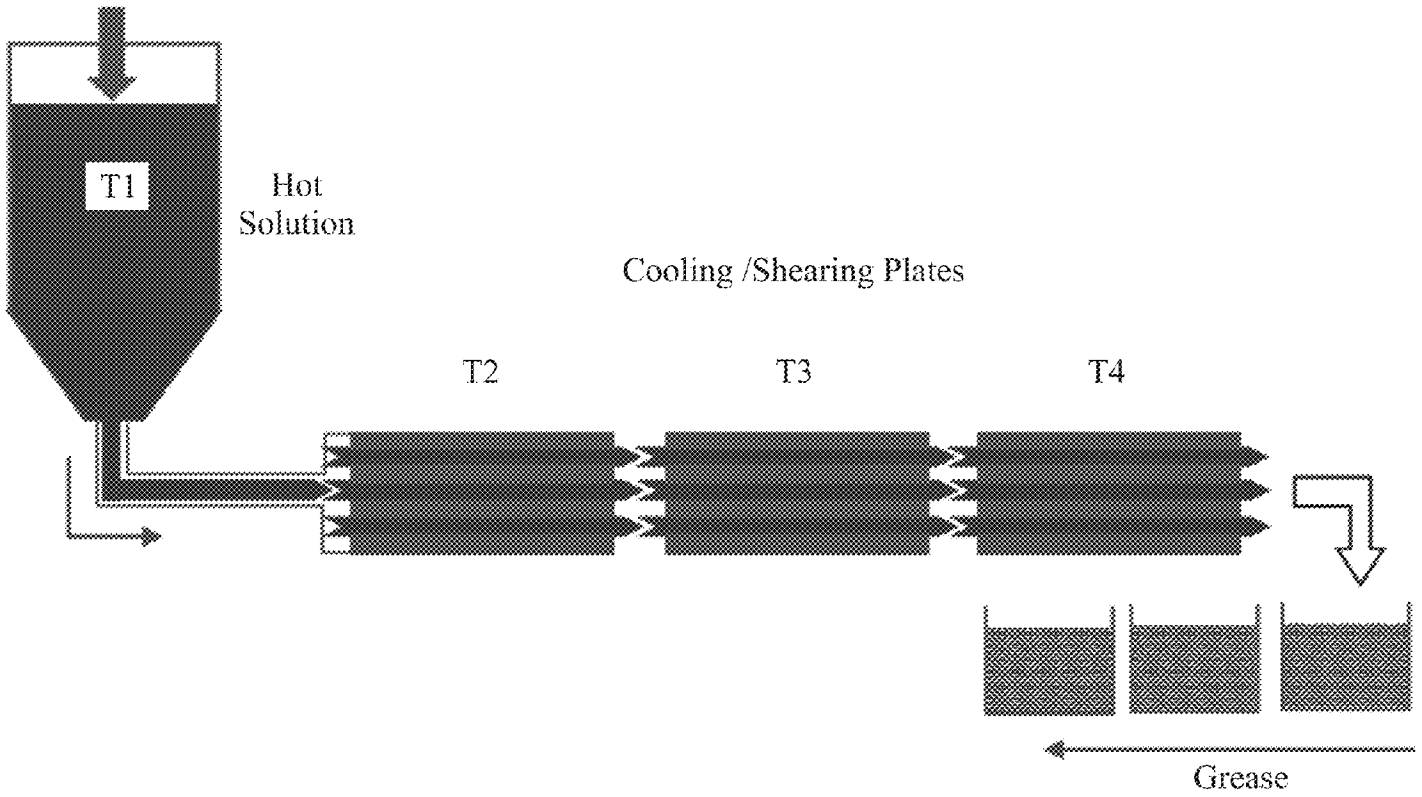
FIG. 2 shows a schematic of an apparatus for use in the present invention.

FIG. 2 shows an example of an apparatus for executing the method of the invention. A reservoir is provided for the hot solution comprising the oil and the thickener as a substantially homogeneous liquid composition. The reservoir has an outlet in fluid communication with a plurality of pairs of cooling/shearing plates. The reservoir is gas-tight and in contact with a source of pressurised gas, by which the solution can be driven through the cooling/shearing plates.

As shown in FIG. 2, the apparatus has three pairs of cooling/shearing plates. These each can be used to hold the liquid composition at a different temperature (see the temperature profile in Example 1 and in FIG. 4). The internal structure between the pairs of plates will determine the flow speed and the amount of shear-mixing that occurs. As shown in FIG. 2, after the sequential treatment between the plates, the grease is continually extruded to fill containers for transport and sale.

Figure 3:
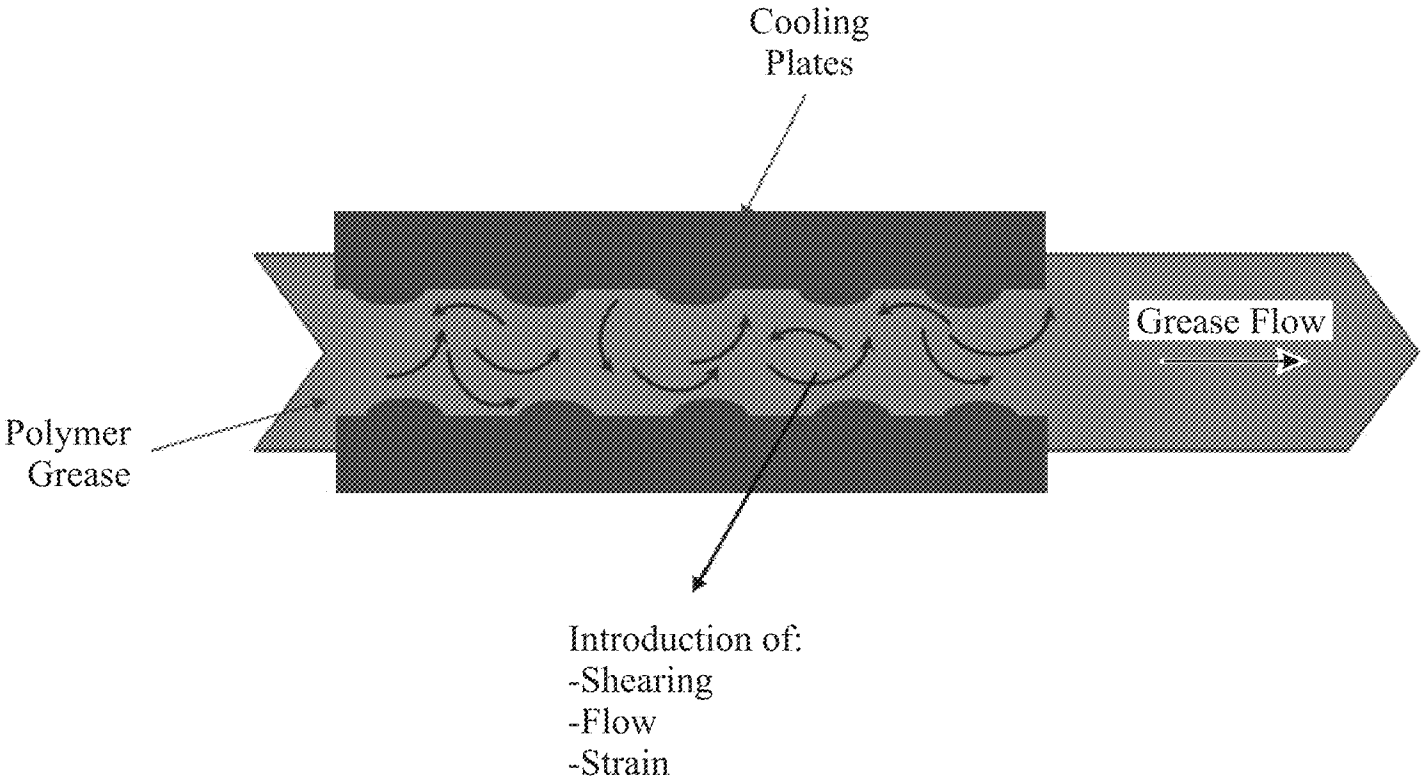
FIG. 3 shows a cross-section of the flow-path used in a method of the present invention.

As shown in FIG. 3, the flow-path between pairs of parallel plates allows for working of the liquid composition. The internal surface texture of the plates acts as baffles for the flow of the liquid composition, causing shear-mixing.

Means may be provided to heat and/or cool one or more of the sets of plates. Cooling may be achieved by water-cooling. Heating may be achieved by the uses of electrical heating elements. One set of plates may comprise both cooling means and heating means.

Figure 4:
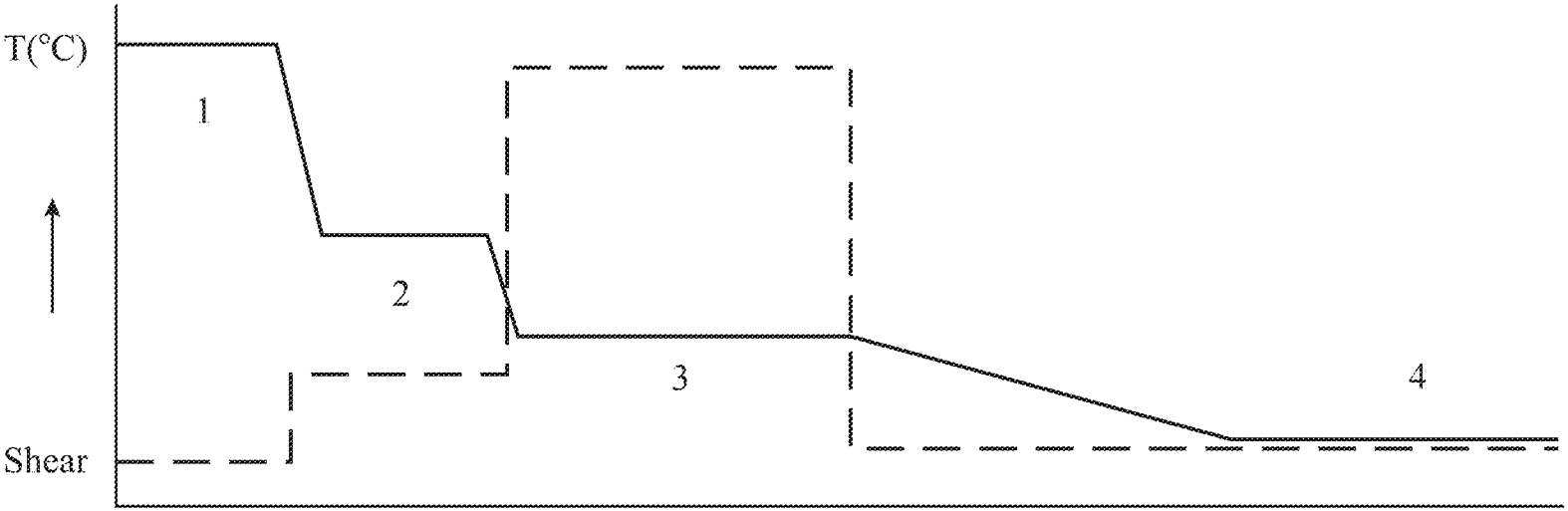
FIG. 4 shows a cooling and shear profile for the Example of the present invention.

FIG. 4 shows a graph over time of the temperature (degrees Celsius) and the shear (Pa) applied in the formation of the grease in Example 1. The liquid composition of the base oil and thickener are held at a high temperature and then cooled step-wise. The shear level is controlled so that is peaks during a second quenching step. As can be seen, the shear changes stepwise as the composition moves from each set of parallel plates, but the rate of temperature change is more finely controlled, with a fast rate of cooling in the first quenching step and a slower rate at the grease is equilibrated.

EXAMPLE 1

The invention will now be described in relation to the following non-limiting example.

A homogeneous mixture was formed comprising a synthetic hydrocarbon/ester mixture as the base oil and the thickening polymer comprising a propylene polymer or co-polymer having a weight average molecular weight of from 50,000 to 100,000. This was passed through a processing unit having the following temperature and shear profile:

| Step | Zone temperature | Shear intensity | Process step |
|---|---|---|---|
| 1 | 190° C. | | Homogeneous polymer/base oil solution |
| 2 | 120° C. | Low shear | $1^{st}$ Quenching step: generation of thickener structure, determination of fiber size |
| 3 | 80° C. | High shear | $2^{nd}$ Quenching step: homogenisation of thickener structure |
| 4 | 25° C. | Low shear | Equilibration |

The final grease had exemplary performance characteristics and was capable of continuous production.

The process as described herein is capable of improving the controllability of polymer grease synthesis. The process can be exploited to investigate the use of new polymers and/or lubricants. Furthermore, the use of a closed system allows the process to be applied beyond what is possible with current batch-production and laboratory-scale synthesis. Use of polymer types with high melting points means that temperatures for the starting mixture can be higher than temperatures currently used, which tend to be limited to a maximum of about 250° C. This allows for the development of greases with a higher temperature-limit compared to current polymer greases.

Although preferred embodiments of the invention have been described herein in detail, it will be understood by those skilled in the art that variations may be made thereto without departing from the scope of the invention or of the appended claims.

The invention claimed is:

1. A process for a manufacture of a lubricating grease composition, the process comprising steps of:

providing an essentially homogeneous liquid composition comprising a lubricating oil and a thickening polymer;

flowing the essentially homogeneous liquid composition through a shear-mixing device to mix and cool the essentially homogeneous liquid composition to form the lubricating grease composition, wherein the thickening polymer forms from 5 to 20 wt % of the essentially homogeneous liquid composition, wherein the liquid composition flows through the shear-mixing device along a flow-path provided with one or more temperature-controlled portions to each at least one of heat and cool the liquid composition, wherein the shear-mixing device comprises at least one pair of heat-transfer plates between which the liquid composition is flowed, wherein the surface of at least one plate is provided with surface features in a flow path of the liquid composition which act as baffles for the flow of the liquid composition, causing shear-mixing.

2. The process according to claim 1, wherein the essentially homogeneous liquid composition is provided at a temperature of from 150 to 350° C. before flowing the essentially homogeneous liquid composition through the shear-mixing device.

3. The process according to claim 1, wherein the lubricating oil comprises one or more oils selected from mineral oils, synthetic hydrocarbons, ester oils, vegetable oils and mixtures of two or more thereof.

4. The process according to claim 1, wherein the thickening polymer comprises a polymer selected from polyamides, polyesters, polyethylene oxides, polyethylene, polypropylene, polylactides, cellulose or cellulose derivatives, including copolymers thereof, and mixtures of two or more thereof.

5. The process according to claim 1, wherein the shear-mixing device is a shear-mixing conduit.

6. The process according to claim 1, wherein the shear-mixing device is a closed gas-tight system.

7. The process according to claim 1, wherein the liquid composition flows through the shear-mixing device along a flow-path provided with at least one static mixing element.

8. The process according to claim 7, wherein the liquid composition flows through the shear-mixing device along a flow-path provided with a plurality of static mixing elements arranged to provide regions of increased shear mixing.

9. The process according to claim 1, wherein the one or more temperature-controlled portions comprise a first temperature-controlled portion and a second temperature-controlled portion disposed downstream of the first temperature-controlled portion in the flow-path, the second temperature-controlled portion being at a higher temperature than the first temperature-controlled portion.

10. The process according to claim 1, wherein the lubricating grease composition is continuously extruded.

11. The process according to claim 1, wherein the shear-mixing is controlled by altering a flow rate of the liquid composition.

12. The process according to claim 1, wherein at least one additive is added to the liquid composition in the shear-mixing device.

13. The process according to claim 1, wherein the essentially homogeneous liquid composition is provided at a temperature of from 200 to 250° C. before flowing the essentially homogeneous liquid composition through the shear-mixing device.

14. The process according to claim 1, wherein the shear-mixing device is a shear-mixing conduit having a cross-sectional area that varies along the flow-path.

15. A method of manufacturing a lubricating grease composition, comprising:

providing an essentially homogeneous liquid composition comprising a lubricating oil and a thickening polymer constituting 5 to 20 wt % of the essentially homogeneous liquid composition; and forcing the essentially homogeneous liquid composition to flow through a shear-mixing device defining a flow path having at least a first temperature-controlled portion and a second temperature-controlled portion such that the essentially homogeneous liquid composition is mixed and cooled in the first and second temperature-controlled portions to form the lubricating grease composition, wherein the second temperature-controlled portion is at a different temperature than the first temperature-controlled portion, the first and second temperature-controlled portions of the shear-mixing device each comprise at least one pair of heat-transfer plates between which the liquid composition flows, a baffle is defined on a surface of at least one of the heat-transfer plates and the baffle is arranged to deflect the flow of the liquid composition along the flow path such that the liquid composition undergoes shear in at least one of the first and second temperature-controlled portions.

16. The process according to claim 15, wherein baffles are defined on both of the heat-transfer plates of the first temperature-controlled portion and on both of the heat-transfer plates of the second temperature-controlled portion.

17. The process according to claim 16, wherein:

the baffles on the heat-transfer plates of the second temperature-controlled portion cause more shear to be generated in the liquid composition than the baffles on the heat-transfer plates of the first temperature-controlled portion; and the heat-transfer plates of the first temperature-controlled portion are held at a higher temperature than the heat-transfer plates of the second temperature-controlled portion.

18. The process according to claim 17, wherein:

the essentially homogeneous liquid composition is provided at a temperature of from 150 to 350° C. before being supplied to the first-temperature controlled portion.

19. The process according to claim 18, wherein:

the essentially homogeneous liquid composition is provided in a reservoir that is fluidly connected to the first and second temperature-controlled portions in a gas-tight manner; and the essentially homogeneous liquid composition is pushed through the first and second temperature-controlled portions by pressurized gas.

20. The process according to claim 19, wherein the lubricating oil comprises a synthetic hydrocarbon/ester mixture and the thickening polymer comprises a propylene polymer or co-polymer having a weight average molecular weight of from 50,000 to 100,000.

* * * * *